US006324705B1

(12) United States Patent
Zephier

(10) Patent No.: US 6,324,705 B1
(45) Date of Patent: Dec. 4, 2001

(54) COMMODE CHAIR WITH ENHANCED USER SUPPORT

(76) Inventor: Hugo Z. Zephier, P.O. Box 265, Marty, SD (US) 57361

( * ) Notice: Subject to any disclaimer, the term of this patent is extended or adjusted under 35 U.S.C. 154(b) by 0 days.

(21) Appl. No.: 09/608,561

(22) Filed: Jun. 30, 2000

(51) Int. Cl.[7] ..... E03D 11/00
(52) U.S. Cl. ..... 4/254
(58) Field of Search ..... 4/239, 254, 667, 4/480, 566.1

(56) References Cited

U.S. PATENT DOCUMENTS

| | | | | |
|---|---|---|---|---|
| D. 257,879 | | 1/1981 | Hicks . | |
| 682,871 | | 9/1901 | Hogan . | |
| 3,050,748 | | 8/1962 | Deutinger . | |
| 3,153,248 | * | 10/1964 | Miller | 4/239 |
| 3,392,411 | | 7/1968 | Hansen . | |
| 3,808,612 | | 5/1974 | Boyle et al. . | |
| 3,921,236 | | 11/1975 | Klein . | |
| 3,969,778 | | 7/1976 | Richards . | |
| 4,196,480 | | 4/1980 | Guenther et al. . | |
| 4,578,829 | * | 4/1986 | Lenosky | 4/237 |
| 4,777,671 | * | 10/1988 | Kearns | 4/667 |
| 5,394,571 | | 3/1995 | Vernon . | |
| 5,619,757 | | 4/1997 | Baratta . | |
| 5,996,133 | * | 12/1999 | Fletcher | 4/239 |

FOREIGN PATENT DOCUMENTS

| | | | | |
|---|---|---|---|---|
| 2631226 | * | 11/1989 | (FR) | 4/254 |
| 9106239 | * | 5/1991 | (WO) | 4/239 |

* cited by examiner

*Primary Examiner*—Charles E. Phillips

(57) ABSTRACT

A commode chair with enhanced user support for reducing pressure concentration points on the body of the user while providing enhanced support of the body of the user. The commode chair includes a commode chair for enhancing sitting comfort on a commode, and which includes a seat assembly, a support assembly, and a bladder. The seat assembly supports the buttocks of a user, and comprises a platform having an upper surface and a lower surface. The support assembly is mounted on the platform assembly for engaging an upper rim portion of the bowl portion of a commode. The bladder has an interior for holding a quantity of air therein. The bladder is mounted on the upper surface of the platform, and the bladder has an upper extent for supporting the buttocks of a user and a lower extent adjacent to the upper surface of the platform. The upper extent is spaced above the lower extent with a cushion of air therebetween.

20 Claims, 3 Drawing Sheets

COMMODE CHAIR WITH ENHANCED USER SUPPORT

BACKGROUND OF THE INVENTION

1. Field of the Invention

The present invention relates to commode chairs and more particularly pertains to a new commode chair with enhanced user support for reducing pressure concentration points on the body of the user while providing enhanced support of the body of the user.

2. Description of the Prior Art

The use of commode chairs is known in the prior art. The primary users of such commode chairs often have some type of physical disability that impairs the freedom of movement of the user. Because of their disabilities, commode chair users can find it difficult, if not impossible, to sense and react to the occurrence of points of excessive and prolonged pressure on the user's body. For example, two points where pressure may concentrate on the buttocks of the user are the areas of flesh surrounding the trochanter and ishial areas of the skeleton. The exposure to the pressure for a prolonged period can lead to a break down of the user's skin, and may produce open sores that can become infected and even lead to amputations of the legs of the user.

Commode chairs heretofore known have included various structures for reducing the supportive pressure exerted on the buttocks of the user. Commode chairs having cushions with enhanced padding, and even inflatable cushions have been devised for reducing the likelihood of problems caused by excess concentrations of pressure on the skin of the user. One concern with cushions that exert less pressure on vulnerable points of the user's body is that these softer cushions tend to provide less firmness for the user, and thus the user tends to feel less stable in the chair. The reduced stability can be of a significant concern to users who do not have full control of their bodies, since these users are less able to react to situations such as, for example, leaning too far in a lateral direction with respect to the commode, or even in a rearward direction toward the rear of the commode. The lessened stability problem appears to be the greatest for the inflatable cushions, since the air within the cushion tends to not provide any significant resistance to these lateral or rearward movements. The air cushions may be provide even less stability when the interior air pressure of the cushion is reduced in order to provide a softer cushion, as compared to higher interior air pressure cushions.

The commode chair with enhanced user support according to the present invention substantially departs from the conventional concepts and designs of the prior art, and in so doing provides an apparatus primarily developed for the purpose of reducing pressure concentration points on the body of the user while providing enhanced support of the body of the user.

SUMMARY OF THE INVENTION

In view of the foregoing disadvantages inherent in the known types of commode chairs now present in the prior art, the present invention provides a new commode chair with enhanced user support construction wherein the same can be utilized for reducing pressure concentration points on the body of the user while providing enhanced support of the body of the user.

The general purpose of the present invention, which will be described subsequently in greater detail, is to provide a new commode chair with enhanced user support apparatus which has many of the advantages of the commode chairs mentioned heretofore and many novel features that result in a new commode chair with enhanced user support which is not anticipated, rendered obvious, suggested, or even implied by any of the prior art commode chairs, either alone or in any combination thereof.

To attain this, the present invention generally comprises a commode chair for enhancing sitting comfort on a commode, and including a seat assembly, a support assembly, and a bladder. The seat assembly supports the buttocks of a user, and comprises a platform having an upper surface and a lower surface. The support assembly is mounted on the platform assembly for engaging an upper rim portion of the bowl portion of a commode. The bladder has an interior for holding a quantity of air therein. The bladder is mounted on the upper surface of the platform, and the bladder has an upper extent for supporting the buttocks of a user and a lower extent adjacent to the upper surface of the platform. The upper extent is spaced above the lower extent with a cushion of air therebetween.

Preferably, an arm rest assembly may be provided for supporting the arms of a user seated on the seat assembly and for providing the user with enhanced lateral support when the user rests his or her arms on the arm rests. Also preferably, a back rest assembly may be provided for providing rearward support for the user. Further, the bladder may have a substantially U-shaped configuration with a rear portion and side portions extending forwardly from the rear portion, and the side portions of the bladder have a gap therebetween forming a channel from the central opening to the front of the platform.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new commode chair with enhanced user support apparatus and method which has many of the advantages of the commode chairs mentioned heretofore and many novel features that result in a new commode chair with enhanced user support which is not anticipated, rendered obvious, suggested, or even implied by any of the prior art commode chairs, either alone or in any combination thereof.

It is another object of the present invention to provide a new commode chair with enhanced user support which may be easily and efficiently manufactured and marketed.

It is a further object of the present invention to provide a new commode chair with enhanced user support which is of a durable and reliable construction.

An even further object of the present invention is to provide a new commode chair with enhanced user support which is susceptible of a low cost of manufacture with regard to both materials and labor, and which accordingly is then susceptible of low prices of sale to the consuming public, thereby making such commode chair with enhanced user support economically available to the buying public.

Still yet another object of the present invention is to provide a new commode chair with enhanced user support which provides in the apparatuses and methods of the prior art some of the advantages thereof, while simultaneously overcoming some of the disadvantages normally associated therewith.

Still another object of the present invention is to provide a new commode chair with enhanced user support for reducing pressure concentration points on the body of the user while providing enhanced support of the body of the user.

Still yet another object of the present invention is to provide a new commode chair with enhanced user support that provides the user with the reduced pressure, "soft" support of a cushion of air while providing the user means for supporting himself and herself in lateral and rearward directions while sitting on the cushion of air.

Even still another object of the present invention is to provide a new commode chair with enhanced user support that permits the air cushion to have a reduced interior pressure to provide a softer cushion without the stability problems inherent in the use of reduced pressure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
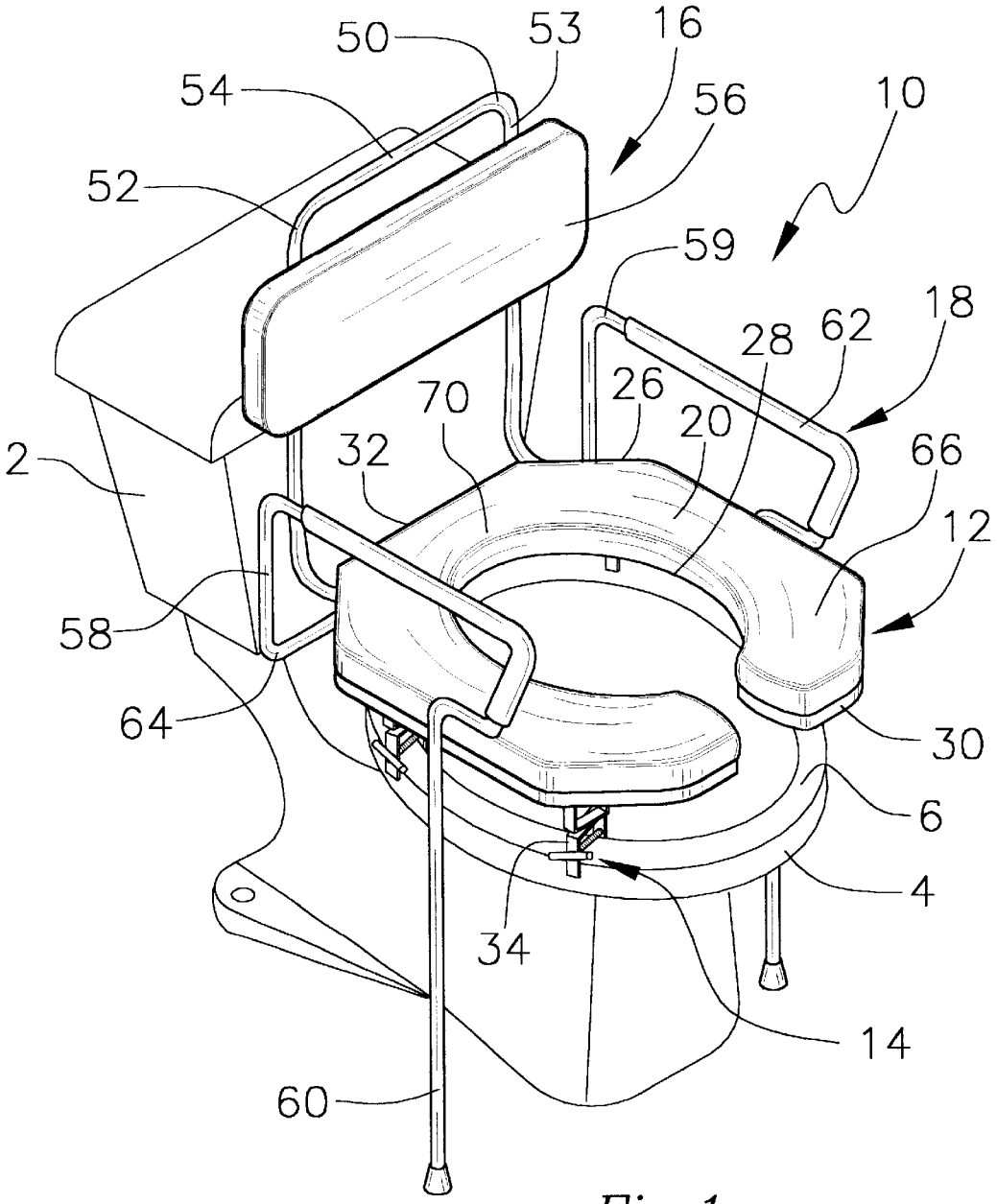
FIG. 1 is a schematic perspective view of a new commode chair with enhanced user support according to the present invention.
Figure 2:
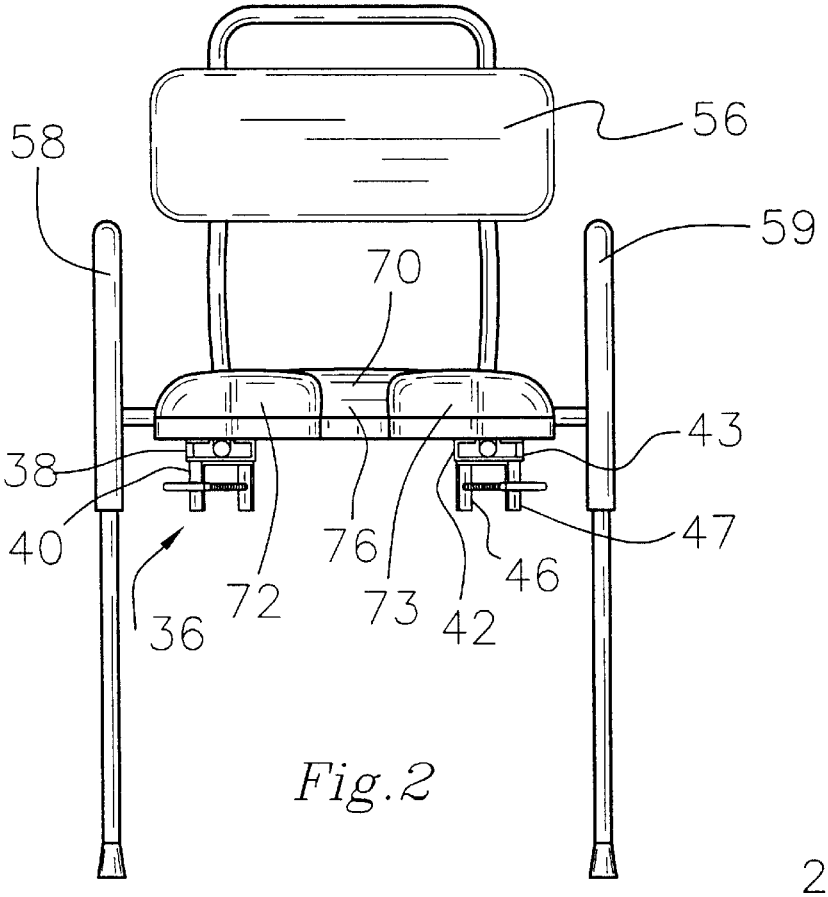
FIG. 2 is a schematic front view of the present invention.
Figure 3:
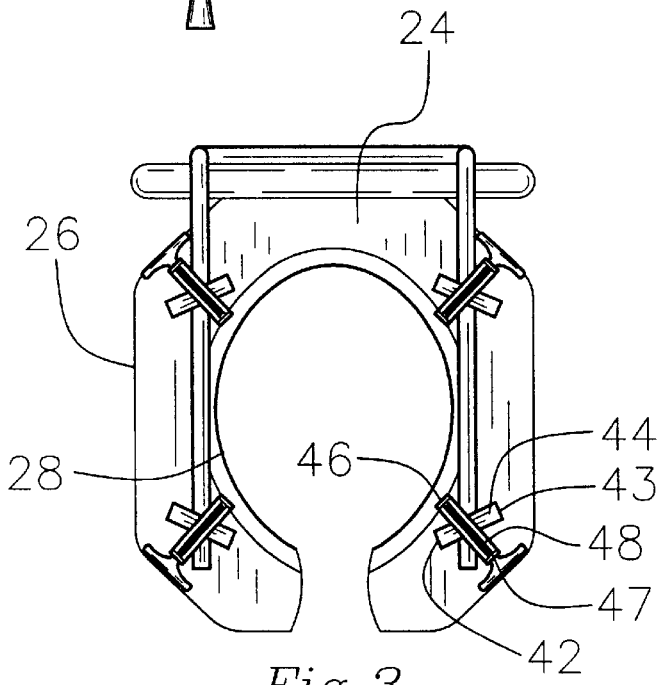
FIG. 3 is a schematic bottom view of the present invention.
Figure 4:
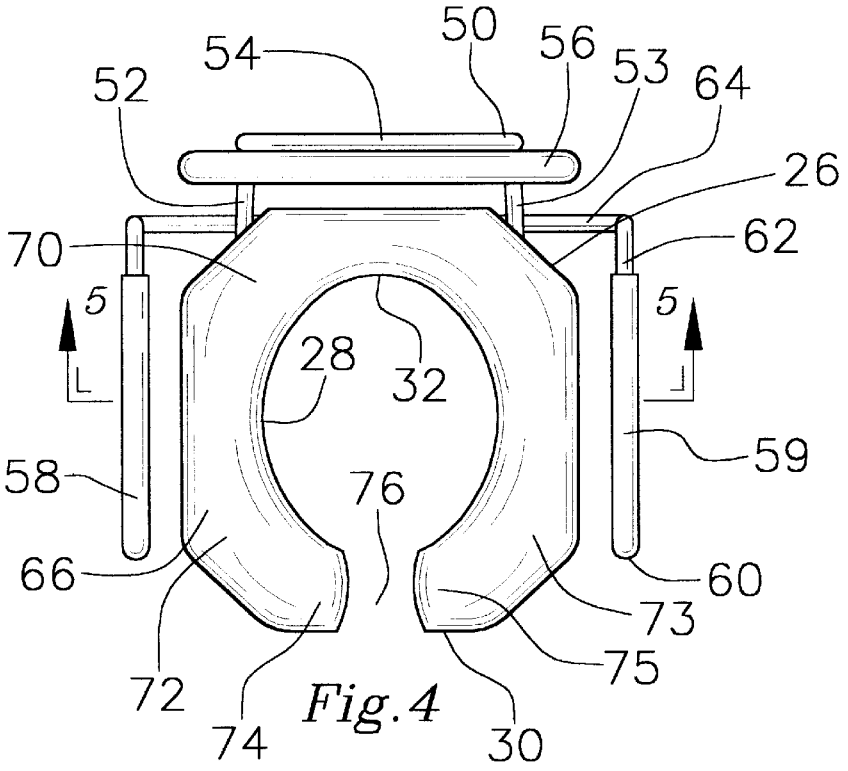
FIG. 4 is a schematic top view of the present invention.
Figure 5:
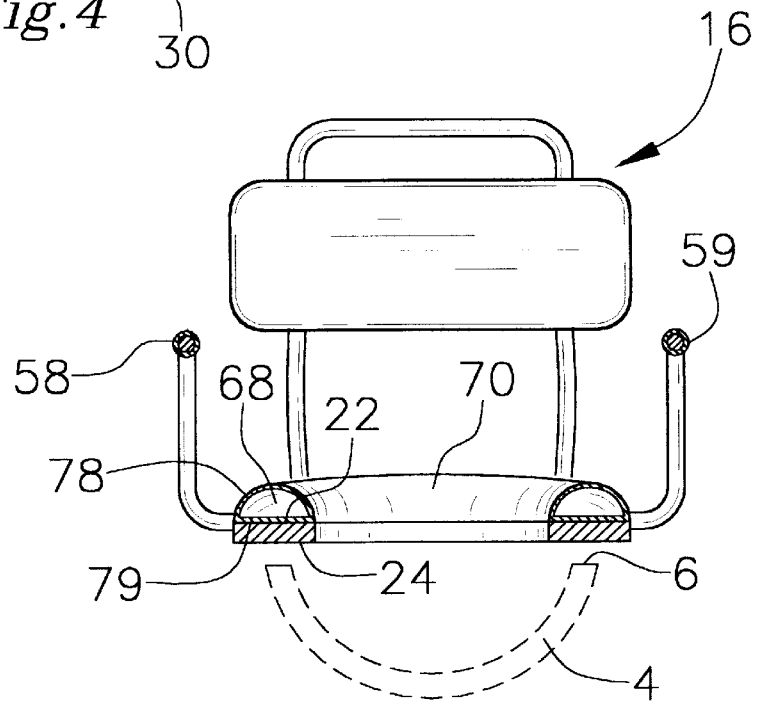
FIG. 5 is a schematic sectional view of the present invention taken along line 5—5 of FIG. 4.

With reference now to the drawings, and in particular to FIGS. 1 through 5 thereof, a new commode chair with enhanced user support embodying the principles and concepts of the present invention and generally designated by the reference numeral 10 will be described.

As best illustrated in FIGS. 1 through 5, the commode chair with enhanced user support 10 generally comprises a seat assembly 12 for supporting the buttocks of a user, a support assembly 14 mounted on the seat assembly for engaging the upper rim portion of a commode, a back rest assembly 16 for supporting the user from the rear of the commode, and an arm rest assembly 18 for supporting the user in lateral directions when the arms of the user are rested on the arm rest assembly.

The invention is highly suitable for use with a commode 2 having a bowl portion 4 with an upper rim portion 6. Ideally, the commode does not have a conventional seat and cover assembly mounted thereon, such that the commode chair of the invention may be securely mounted on the upper rim portion of the commode.

The seat assembly 12 of the invention most preferably includes a relatively rigid member, or platform 20, having an upper surface 22 and a lower surface 24, and a relatively uniform thickness therebetween. An outer perimeter edge 26 of the platform 20 extends between the upper and lower surfaces of the platform. A central opening in the platform is defined by an inner perimeter edge 28 of the platform. The platform generally has a front 30 and a rear 32 that are oriented on the commode 2 in an orientation corresponding to the front and rear of the upper rim portion 6 of the bowl portion 4 of the commode.

The support assembly 14 is mounted on the platform assembly, and most preferably includes a commode rim engaging structure 34 mounted on the lower surface of the platform for engaging the upper rim portion of a commode bowl portion. The rim engaging structure includes at least two rim clamp devices 36, and ideally includes four clamp devices positioned with two clamps in the rear of the platform, and with two clamps at the front of the platform.

Each of the rim lamp devices 36 may comprise a base mounting structure 38 and a rim holding member 40. The base mounting structure is mounted on the lower surface of the platform, and may include a pair of spaced first members 42, 43 and a second member 44 linking ends of the first members to form a looped structure with the lower surface of the platform. The rim holding member 40 is pivotally mounted to the base mounting member 38 for adapting to the orientation of the generally arcuate upper rim portion of the commode. The rim holding member 40 may include a pair of spaced arms 46, 47 for embracing an upper rim portion of the bowl. A biasing member 48 may extend between the spaced arms for selectively moving the arms toward each other for effecting a pinching engagement of the side surfaces of the upper rim portion of the commode bowl. Suitably, the biasing member 48 may comprise a threaded fastener extending through threaded apertures in the arms.

The back rest assembly 16 of the invention in a highly preferred embodiment includes a support loop 50 having a pair of side bars 52, 53 with lower ends mounted on the lower surface of the platform. The support loop 50 also includes an upper crossbar 54 extending between upper ends of the side bars 52, 53. A back rest pad 56 is preferably mounted on the side bars at a location below the upper crossbar, and has a resiliently compressible front surface for the user to rest his or her back against.

The arm rest assembly 18 of the invention preferably is supported both on a floor surface laterally adjacent to the bowl portion of the commode and on a rear surface of the upper rim portion of the bowl portion. The arm rest assembly 18 includes two sides 58, 59, with one side positioned on each lateral side of the commode bowl. Each side includes a leg portion 60 oriented substantially perpendicular to the platform and that extends downwardly for engaging a floor surface. The leg portion extends upwardly to a rest portion 62 of the arm rest assembly. The rest portion is oriented substantially parallel to a side edge of the platform, and extends from the relatively forward position of the leg portion to the rear of the bowl portion. A mounting portion 64 of the arm rest portion is oriented substantially parallel to a rear edge of the platform, and extends transversely across the upper rim surface portion of the other side of the arm rest assembly.

Significantly, the invention includes a bladder 66 having an interior 68 for holding a quantity of air therein. The bladder is mounted on the upper surface 22 of the platform 20. Preferably, the bladder has a substantially U-shaped configuration with a rear portion 70 and side portions 72, 73 extending forwardly from the rear portion. Forward ends 74, 75 of the side portions preferably have a gap 76 therebetween to form a channel from the central opening to the front of the platform. The bladder has an upper extent 78 for supporting the buttocks of a user and a lower extent 79 located adjacent to the upper surface of the platform. The upper extent is spaced above the lower extent with a cushion of air therebetween. Ideally, the upper extent is spaced at least approximately two inches from the lower extent. The bladder may be formed from any suitable flexible, air retaining material such as an elastomer.

In use, the user sits on the inflated bladder and is able to lean on the arm rests and the back rest if necessary, especially if the bladder is inflated with a relatively small amount of air to enhance the softness of the bladder against the buttocks of the user. If the user becomes unstable while sitting on the bladder, such as by rocking laterally to one side, the user may use one or both of the arms rests to stabilize himself or herself, with the leg portions of the arm rest assembly resisting the tipping of the user. Similarly, the any tipping of the user rearward is resisted by the back rest assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A commode chair for enhancing sitting comfort on a commode, comprising:

a seat assembly for supporting the buttocks of a user, the seat assembly comprising a platform having an upper surface and a lower surface, an outer perimeter edge extending between the upper and lower surfaces, and a central opening defined by an inner perimeter edge, the platform having a front and a rear;

a support assembly mounted on the platform for engaging an upper rim portion of the bowl portion of a commode; and a bladder having an interior for holding a quantity of air therein, the bladder being mounted on the upper surface of the platform, wherein the bladder has an upper extent for supporting the buttocks of a user and a lower extent adjacent to the upper surface of the platform, the upper extent being spaced above the lower extent with a cushion of air therebetween;

a back rest assembly comprising a support loop having a pair of side bars with lower ends mounted on the platform and an upper crossbar extending between upper ends of the side bars, and a back rest pad mounted on the side bars below the upper crossbar, the back rest pad having a resiliently compressible front surface.

2. The commode chair of claim 1 wherein the bladder has a substantially U-shaped configuration with a rear portion and side portions extending forwardly from the rear portion.

3. The commode chair of claim 2 wherein the side portions of the bladder have a gap therebetween forming a channel from the central opening to the front of the platform.

4. The commode chair of claim 1 wherein the upper extent of the bladder is spaced at least approximately two inches from the lower extent of the bladder.

5. The commode chair of claim 1 additionally comprising an arm rest assembly for supporting the arms of a user seated on the seat assembly.

6. The commode chair of claim 5 wherein the arm rest assembly comprises a leg portion oriented substantially perpendicular to the platform, a rest portion oriented substantially parallel to a side edge of the platform, and a mounting portion oriented substantially parallel to a rear edge of the platform.

7. The commode chair of claim 1 wherein the support assembly includes a commode rim engaging structure mounted on the lower surface of the platform for engaging an upper rim portion of a commode bowl.

8. The commode chair of claim 7 wherein the rim engaging structure includes at least two rim clamp devices, each of the rim clamp devices comprising a base mounting member and a rim holding member.

9. The commode chair of claim 8 wherein the base mounting member is mounted on the lower surface of the platform, the base mounting member having a pair of spaced first members and a second member linking ends of the first members.

10. The commode chair of claim 8 wherein the rim holding member is pivotally mounted to the base mounting member, the rim engaging structure including a pair of spaced arms for embracing an upper rim portion of the commode bowl.

11. The commode chair of claim 10 wherein the rim holding member includes a biasing member extending between the spaced arms for selectively moving the arms toward each other for engaging sides of the upper rim portion of the commode bowl.

12. The commode chair of claim 11 wherein the biasing member comprises a threaded fastener extending through threaded apertures in the arms.

13. A commode chair for enhancing sitting comfort on a commode, comprising:

a seat assembly for supporting the buttocks of a user, the seat assembly comprising a platform having an upper surface and a lower surface, an outer perimeter edge extending between the upper and lower surfaces, and a central opening defined by an inner perimeter edge, the platform having a front and a rear;

a support assembly mounted on the platform for engaging an upper rim portion of the bowl portion of a commode; and a bladder having an interior for holding a quantity of air therein, the bladder being mounted on the upper surface of the platform, wherein the bladder has an upper extent for supporting the buttocks of a user and a lower extent adjacent to the upper surface of the platform, the upper extent being spaced above the lower extent with a cushion of air therebetween;

wherein the support assembly includes a commode rim engaging structure mounted on the lower surface of the platform for engaging an upper rim portion of a commode bowl, the rim engaging structure including at least two rim clamp devices, each of the rim clamp devices comprising a base mounting member and a rim holding member, the rim holding member being pivotally mounted to the base mounting member, the rim engaging structure including a pair of spaced arms for embracing an upper rim portion of the commode bowl.

14. A commode chair for enhancing sitting comfort on a commode, comprising:

a seat assembly for supporting the buttocks of a user, the seat assembly comprising a platform having an upper surface and a lower surface, an outer perimeter edge extending between the upper and lower surfaces, and a central opening defined by an inner perimeter edge, the platform having a front and a rear;

a support assembly mounted on the platform, the support assembly including a commode rim engaging structure mounted on the lower surface of the platform for engaging an upper rim portion of a commode bowl, the rim engaging structure including at least two rim clamp devices;

a back rest assembly comprising a support loop having a pair of side bars with lower ends mounted on the platform and an upper crossbar extending between upper ends of the side bars, and a back rest pad mounted on the side bars below the upper crossbar, the back rest pad having a resiliently compressible front surface;

an arm rest assembly for supporting the arms of a user seated on the seat assembly; and a bladder having an interior for holding a quantity of air therein, the bladder being mounted on the upper surface of the platform, the bladder having a substantially U-shaped configuration with a rear portion and side portions extending forwardly from the rear portion, forward ends of the side portions having a gap therebetween forming a channel from the central opening to the front of the platform, wherein the bladder has an upper extent for supporting the buttocks of a user and a lower extent adjacent to the upper surface of the platform, the upper extent being spaced above the lower extent with a cushion of air therebetween.

15. The commode chair of claim 14 wherein each of the rim clamp devices comprises:

a base mounting member mounted on the lower surface of the platform, the base mounting member having a pair of spaced first members and a second member linking ends of the first members, and a rim holding member pivotally mounted to the base mounting member, the rim holding member including a pair of spaced arms for embracing an upper rim portion of the commode bowl, a biasing member extending between the spaced arms for selectively moving the arms toward each other for engaging sides of the upper rim portion of the commode bowl, the biasing member comprising a threaded fastener extending through threaded apertures in the arms.

16. The commode chair of claim 14 wherein the upper extent of the bladder is spaced at least approximately three inches from the lower extent of the bladder.

17. A commode chair for enhancing sitting comfort on a commode, comprising:

a seat assembly for supporting the buttocks of a user, the seat assembly comprising a platform having an upper surface and a lower surface, an outer perimeter edge extending between the upper and lower surfaces, and a central opening defined by an inner perimeter edge, the platform having a front and a rear;

a support assembly mounted on the platform, the support assembly including a commode rim engaging structure mounted on the lower surface of the platform for engaging an upper rim portion of a commode bowl, the rim engaging structure including at least two rim clamp devices, each of the rim clamp devices comprising:

a base mounting member mounted on the lower surface of the platform, the base mounting member having a pair of spaced first members and a second member linking ends of the first members;

a rim engaging structure pivotally mounted to the base mounting member, the rim engaging structure including a pair of spaced arms for embracing an upper rim portion of the commode bowl, a biasing member extending between the spaced arms for selectively moving the arms toward each other for engaging sides of the upper rim portion of the commode bowl, the biasing member comprising a threaded fastener extending through threaded apertures in the arms;

a back rest assembly comprising a support loop having a pair of side bars with lower ends mounted on the platform and an upper crossbar extending between upper ends of the side bars, and a back rest pad mounted on the side bars below the upper crossbar, the back rest pad having a resiliently compressible front surface;

an arm rest assembly for supporting the arms of a user seated on the seat assembly, the arm rest assembly comprising a leg portion oriented substantially perpendicular to the platform, a rest portion oriented substantially parallel to a side edge of the platform, a mounting portion oriented substantially parallel to a rear edge of the platform; and a bladder having an interior for holding a quantity of air therein, the bladder being mounted on the upper surface of the platform, the bladder having a substantially U-shaped configuration with a rear portion and side portions extending forwardly from the rear portion, forward ends of the side portions having a gap therebetween forming a channel from the central opening to the front of the platform, wherein the bladder has an upper extent for supporting the buttocks of a user and a lower extent adjacent to the upper surface of the platform, the upper extent being spaced above the lower extent with a cushion of air therebetween, wherein the upper extent is spaced at least approximately three inches from the lower extent, the bladder being formed from an elastomeric material.

18. A commode chair for enhancing sitting comfort on a commode, comprising:

a seat assembly for supporting the buttocks of a user, the seat assembly comprising a platform having an upper surface and a lower surface, an outer perimeter edge extending between the upper and lower surfaces, and a central opening defined by an inner perimeter edge, the platform having a front and a rear;

a support assembly mounted on the platform for engaging an upper rim portion of the bowl portion of a commode; and a bladder having an interior for holding a quantity of air therein, the bladder being mounted on the upper surface of the platform, wherein the bladder has an upper extent for supporting the buttocks of a user and a lower extent adjacent to the upper surface of the platform, the upper extent being spaced above the lower extent with a cushion of air therebetween; an arm rest assembly for supporting the arms of a user seated on the seat assembly, the arm rest assembly comprising a leg portion oriented substantially perpendicular to the platform, a rest portion oriented substantially parallel to a side edge of the platform, and a mounting portion oriented substantially parallel to a rear edge of the platform.

19. The commode chair of claim 18 additionally comprising a back rest assembly comprising a support loop having a pair of side bars with lower ends mounted on the platform and an upper crossbar extending between upper ends of the side bars, and a back rest pad mounted on the side bars below the upper crossbar, the back rest pad having a resiliently compressible front surface.

20. The commode chair of claim 18 wherein the support assembly includes a commode rim engaging structure mounted on the lower surface of the platform for engaging an upper rim portion of a commode bowl, the rim engaging structure including at least two rim clamp devices, each of the rim clamp devices comprising a base mounting member and a rim holding member, the base mounting member being mounted on the lower surface of the platform, the rim holding member is pivotally mounted to the base mounting member.

* * * * *